US006177399B1

(12) United States Patent
Mei et al.

(10) Patent No.: US 6,177,399 B1
(45) Date of Patent: Jan. 23, 2001

(54) PROCESS FOR CLEANING TEXTILE UTILIZING A LOW MOLECULAR WEIGHT SILOXANE

(75) Inventors: Wang Ping Mei, Taipei; Peter S. Wu, Chungli, both of (TW); Samuel N. Chiang, Singapore (SG)

(73) Assignee: Dow Corning Taiwan, Inc., Taipei (TW)

( * ) Notice: Under 35 U.S.C. 154(b), the term of this patent shall be extended for 0 days.

(21) Appl. No.: 09/399,429

(22) Filed: Sep. 20, 1999

(30) Foreign Application Priority Data

Oct. 7, 1998 (TW) ..... 87116635

(51) Int. Cl.[7] ..... C11D 9/36; C11D 1/62

(52) U.S. Cl. ..... 510/466; 510/276; 510/329; 510/347; 510/417; 510/504

(58) Field of Search ..... 510/276, 329, 510/347, 417, 466, 504

(56) References Cited

U.S. PATENT DOCUMENTS 4,302,364 * 11/1981 Gosset et al. ..... 252/545
4,637,890 * 1/1987 Crabtree et al. ..... 252/90
4,654,041 3/1987 Nickel ..... 8/137
4,685,930 8/1987 Kasprzak ..... 8/139.1

FOREIGN PATENT DOCUMENTS 37 39711 A1 6/1989 (DE) ..... D06L/1/02

* cited by examiner

*Primary Examiner*—Necholus Ogden
*Assistant Examiner*—Charles Boyer
(74) *Attorney, Agent, or Firm*—Duane, Morris & Heckscher

(57) ABSTRACT

This invention relates to a process for cleaning textiles, which comprises applying a composition comprising a low molecular weight linear siloxane represented by the formula:

$$CH_3((CH_3)_2SiO)_nSi(CH_3)_2CH_3$$

wherein n is an integer from 1 to 7, and a cationic surfactant to stained textiles and heating it in the presence of an inorganic base compound at a temperature below which the textiles are deteriorated.

17 Claims, No Drawings

PROCESS FOR CLEANING TEXTILE UTILIZING A LOW MOLECULAR WEIGHT SILOXANE

FIELD OF THE INVENTION

The present invention relates to a process for cleaning textiles, especially for removal of any oily and /or greasy stains from textiles and for removal of silicones retained on textiles.

BACKGROUND OF THE INVENTION

Historically, any oily/greasy stains have been removed from textiles by various manners for cleaning purposes. On the other hand, silicone fluids have been used as textile treating agents to impart smoothness, softness, and the like. However, the presence of such silicone treating agents on textiles adversely affects re-dying of the textiles, so they must be removed before re-dying. Therefore, a product referred to as a "stripping agent", produced by the combination of cationic surfactants, is commercially available but is not entirely satisfactory, especially for aminosilicone textile treating agents.

A low molecular weight siloxane known as "volatile siloxane" has been used for cleaning a substrate including textile. It is often used in combination with a surfactant. These are disclosed in the following patents which are incorporated herein by reference. The cyclic siloxanes employed in these prior art patents do not work in the present invention.

U.S. Pat. No. 4,654,041 discloses a process for removing silicone from fibers, yarns or two-dimensional textile materials by the action of aqueous preparations, which may contain surfactive equilibration catalyst for organosiloxanes, and optionally detergents, wetting agents and alkali carbonates.

U.S. Pat. No. 4,685,930 discloses a method for cleaning textiles which comprises applying a liquid composition consisting essentially of a cyclic siloxane and surfactant such as anionic, non-ionic, zwitterionic or ampholytic surfactant to a textile soiled with oil, grease or sebum, and removing from the textile a combination comprising cyclic siloxane and oil, grease or sebum.

DE 3739711A1 discloses a cleaning agent comprising cyclosiloxane and an anionic, cationic and/or ionic surfactant, which is used for cleaning fabrics.

SUMMARY OF THE INVENTION

The present invention relates to a process for cleaning textiles, which comprises applying a composition comprising a low molecular weight linear siloxane represented by the formula:

$$CH_3((CH_3)_2SiO)_nSi(CH_3)_2CH_3$$

wherein n is an integer from 1 to 7, and a cationic surfactant to stained textiles in the presence of an inorganic base compound and heating the textiles at a temperature below which the textiles are deteriorated.

The method of the present invention can remove any oily and/or greasy stains from textiles and silicones retained on textiles.

DETAILED DESCRIPTION OF THE INVENTION

The process of the present invention for cleaning textiles comprises applying a composition comprising a low molecular weight linear siloxane represented by the a formula:

$$CH_3((CH_3)_2SiO)_nSi(CH_3)_2CH_3$$

wherein n is an integer from 1 to 7, and a cationic surfactant to stained textiles and heating the textiles in the presence of an inorganic base compound at a temperature below which the textiles are deteriorated.

The low molecular weight linear siloxanes of the present invention represented by the formula $$CH_3((CH_3)_2SiO)_nSi(CH_3)_2CH_3$$

wherein n is an integer from 1 to 7, are well known in the art. The siloxanes suitable for the invention should have viscosity less than about 5 cs. The siloxanes having more than about 5 cs. cannot be employed in the present invention. Preferred siloxanes include dimers, trimers and tetramers. As shown in the comparative example, a cyclic siloxane cannot be used in this invention. The silicone stains would become swelled after absorbing the siloxanes of this invention and easier to be cut into small fragments by strong bases carried by the cationic surfactants, and the fragments can be dissolved in the siloxane fluid. When the low molecular weight siloxane is applied together with a cationic surfactant and a base, it can promote the "cutting" efficiency because it can behave as a solvent to swell silicone and allow hydroxy ion to penetrate into the inner part of an oil spot more easily.

The cationic surfactant employed in the present invention can be a quaternary ammonium salt. Preferably, it can be selected from the group consisting of trialkylmethylammonium salts, dialkyldimethylammonium salts and mixtures thereof. The quaternary ammonium salts wherein the alkyl radical contains from 8 or less to 16 or more carbon atoms and the salt is chloride or bromide, are commercially available. Trilaurylmethyl ammonium chloride and didecyldimethylammonium chloride are most preferable. These ammonium salts are used individually or as mixtures thereof or in combination with other ammonium salts such as alkylbenzyldimethylammonium salts. Cationic surfactants alone can neutralize the negative charges on fabric surfaces and enable strong bases closing to and reacting with silicone oil spots (cutting polysiloxanes into small fragments) to remove them from fabric surfaces. The base is a real silicone stripper and the cationic surfactant is an auxiliary which helps the base penetrate more easily.

The base compounds suitable for the present invention depend on the materials of textiles. Preferred inorganic base compounds of the present invention are NaOH, KOH, $Na_2CO_3$, $NaHCO_3$ and the like. Depending on the materials of textiles, for example, NaOH is good for cotton fabrics but not for wools. $Na_2CO_3$ or $NaHCO_3$ is preferred for wools.

The composition of the present invention can further comprise other ingredients. For example, a non-ionic surfactant may be added to the composition, which is used to stabilize the composition of the present invention. Since the composition is generally added to an aqueous system, it is preferably used in form of an emulsion. Persons skilled in the art know that any non-ionic surfactant is useful to meet this requirement. In addition, biocides can be used as preservatives for emulsions.

The proportions of the components are not critical to the composition of the present invention. However, generally, the ratio of the low molecular weight linear siloxane to the cationic surfactant is in the range of from about 1:25 to 25:1. The ratio of the sum of the low molecular weight linear siloxane plus the cationic surfactant to the base compound (on the basis of effective ingredient) is in the range of from about 16:1 to 16:20.

The order of addition of the components is not critical. It is preferred to previously produce a cleaning composition comprising the low molecular weight linear siloxane and cationic surfactants in the form of an aqueous emulsion, and add the cleaning composition and the inorganic base to a cleaning bath where water and a stained textile are loaded in, and then heat the cleaning bath at a temperature above the room temperature. The upper limit of the temperature may be the temperature under which the textile can be exposed without thermal deterioration. The temperature varies depending on the length of heating time. For example, the temperature is preferably from about 80 to 100 degrees C., and the time is preferably from about 30 minutes to 3 hours. The lower temperature can be used, but more time will be needed. After the cleaning treatment, the textile may be neutralized with a weak acid such as acetic acid.

The efficacy of the process of the invention is further illustrated by the following examples which are provided for illustration but not for limitation of the scope of the invention.

EXAMPLES (A) The following examples demonstrate the removal of oil spots from textiles by the process of the invention.

Various cleaning compositions were prepared by mixing the cationic surfactants and the non-ionic surfactants with water and then adding a low molecular weight siloxane to the composition under stirring. The quantities (unit: grams) of the components are described in Table 1.

TABLE 1

| | Composition | | | | | | | | |
|---|---|---|---|---|---|---|---|---|---|
| Components | I | II | III | IV | V | VI | VII | VIII | IX |
| Siloxane (1) | — | — | — | — | — | — | — | — | — |
| Siloxane (2) | 0.66 | 0.66 | 0.66 | 0.66 | 0.86 | 0.26 | 0.63 | 0.66 | 0.63 |
| Siloxane (3) | — | — | — | — | — | — | — | — | |
| Cationic Surfactant(a) | 0.19 | — | 0.095 | 0.06 | 0.03 | 0.12 | 0.06 | 0.06 | 0.16 |
| Cationic Surfactant(b) | — | 0.19 | 0.095 | 0.03 | 0.02 | 0.06 | 0.03 | 0.03 | 0.03 |
| Cationic Surfactant(c) | — | — | — | 0.1 | 0.05 | 0.2 | 0.1 | 0.1 | |
| Cationic Surfactant(d) | — | — | — | — | — | — | — | — | |
| Non-Ionic Surfactants(1) | 0.06 | 0.06 | 0.06 | 0.06 | 0.08 | 0.02 | 0.01 | 0.05 | — |
| Non-Ionic Surfactants(2) | 0.31 | 0.31 | 0.31 | 0.31 | 0.15 | 0.62 | 0.31 | — | — |
| Non-Ionic Surfactants (3) | 0.103 | 0.103 | 0.103 | 0.103 | 0.15 | 0.006 | 0.003 | 0.1 | — |
| Water | 0.49 | 0.49 | 0.49 | 0.49 | 0.5 | 0.48 | 0.24 | 0.813 | 0.563 |
| Organic Solvents | 0.187 | 0.187 | 0.187 | 0.187 | 0.16 | 0.234 | 0.117 | 0.187 | 0.117 |
| TOTAL | 2 | 2 | 2 | 2 | 2 | 2 | 1.5 | 2 | 1.5 |

| Components | X | XI | XII | XIII | XIV | XV | XVI | XVII |
|---|---|---|---|---|---|---|---|---|
| Siloxane (1) | 0.62 | — | — | — | — | — | — | — |
| Siloxane (2) | — | 0.63 | 0.66 | 0.66 | 0.66 | 1.06 | — | — |
| Siloxane (3) | — | — | — | — | — | — | — | 0.62 |
| Cationic Surfactant(a) | 0.06 | 0.06 | — | — | — | — | 0.12 | 0.06 |
| Cationic Surfactant(b) | 0.03 | 0.03 | — | — | 0.095 | — | 0.06 | 0.03 |
| Cationic Surfactant(c) | 0.1 | 0.1 | 0.19 | — | 0.095 | — | 0.2 | 0.1 |
| Cationic Surfactant(d) | — | — | — | 0.19 | — | — | — | — |
| Non-Ionic Surfactants(1) | 0.01 | — | 0.06 | 0.06 | 0.06 | 0.1 | 0.02 | 0.01 |
| Non-Ionic Surfactants(2) | 0.31 | — | 0.31 | 0.31 | 0.31 | — | 0.62 | 0.31 |
| Non-Ionic Surfactants (3) | 0.003 | — | 0.103 | 0.103 | 0.103 | 0.2 | 0.006 | 0.003 |
| Water | 0.37 | 0.563 | 0.49 | 0.49 | 0.49 | 0.5 | 0.74 | 0.37 |
| Organic Solvents | 0.117 | 0.117 | 0.187 | 0.187 | 0.187 | 0.14 | 0.234 | 0.117 |
| TOTAL | 1.62 | 1.5 | 2 | 2 | 2 | 2 | 2 | 1.62 |

| | |
|---|---|
| Siloxane (1) | Hexamethyldisiloxane (0.65 cs) |
| Siloxane (2) | Decamethyltetrasiloxane (1.5 cs) |
| Siloxane (3) | Cyclic octamethyltetrasiloxane |
| Cationic Surfactant(a) | Trilaurylmethylammonium chloride |
| Cationic Surfactant(b) | Didecyldimethylammonium chloride |
| Cationic Surfactant(c) | Alkylbenzyldimethylammonium chloride |
| Cationic Surfactant(d) | Cetyl trimethyl ammonium chloride |
| Non-ionic Surfactants(1) | 2,6,8-trimethyl-4-nonyloxypolyethylene-oxyethanol |
| Non-ionic Surfactants(2) | alpha-($C_{12}$–$C_{15}$ sec-alkyl)omega-hydroxy poly(oxyethylene) |
| Non-ionic Surfactants (3) | alpha-($C_{12}$–$C_{14}$ sec-alkyl)omega-hydroxy poly-(xyethylene) |
| Organic solvents: | Isopropanol or ethylene glycol and unknown solvent residue of the surfactants. |

On a piece (6 grams) of cotton textile to be tested containing 0.2 percent by weight (by weight of fabric) of silicone softener (polydimethylmethyl(aminoethylamino-isobutyl)siloxane with viscosity of 1,500 cs.), 0.1 gram of the same silicone softener was spread to form an oil circle.

In a cleaning vessel 80 grams of water was loaded first. Then the stained textile, the cleaning composition and 0.2 grams of 50% NaOH were loaded, and stirred for 60 minutes at a temperature of 90 degrees C. The cleaning solution was drained off, the textile was rinsed with water, and 0.093 grams of 60% acetic acid was added to neutralize the textile. The textile was again rinsed with water and dried at a temperature of 180 degrees C. for two minutes.

After drying, the cleaned textiles were observed by dropping water. When the oil spot was completely removed, it was rated as 5, and when the oil spot was not removed, it was rated as 0. The results are as shown in Table 2.

TABLE 2

| Working Examples | Cleaning Compositions | Cleaning Rated |
|---|---|---|
| Working Example 1 | Composition I | 5 |
| Working Example 2 | Composition II | 3 |
| Working Example 3 | Composition III | 5 |
| Working Example 4 | Composition IV | 5 |
| Working Example 5 | Composition V | 5 |
| Working Example 6 | Composition VI | 3 |
| Working Example 7 | Composition VII | 5 |
| Working Example 8 | Composition VIII | 5 |
| Working Example 9 | Composition IX | 4 |
| Working Example 10 | Composition X | 5 |
| Working Example 11 | Composition XI | 3 |
| Comparative Example 1 | Composition XII | 1 |
| Comparative Example 2 | Composition XIII | 1 |
| Comparative Example 3 | Composition XIV | 2 |
| Comparative Example 4 | Composition XV | 0–1 |
| Comparative Example 5 | Composition XVI | 1 |
| Comparative Example 6 | Composition XVII | 0–1 |

It is apparent that the process of the invention is more effective to remove the oil spot from the textile than the known process.

(B) The following examples demonstrate the removal of silicone retained onto the textiles by the process of the invention (for a re-dying process).

0.3 grams of a cleaning composition in the form of an emulsion was prepared by mixing the cationic surfactants (Cationic Surfactant (a) 0.018 grams; Cationic Surfactant (b) 0.009 grams; Cationic Surfactant (c) 0.030 grams) and the non-ionic surfactants (Non-ionic Surfactant (1) 0.003 grams; Non-ionic Surfactant (2) 0.093 grams; Non-ionic Surfactant (3) 0.001 gram) with 0.072 grams of water and 0.035 grams of miscellaneous organic solvent and then adding the low molecular weight siloxane (Siloxane (2) 0.039 grams) to the composition under stirring.

Onto a piece (6 grams) of dyed cotton textile to be tested, 0.2 percent by weight (by weight of fabric) of silicone softener (polydimethylmethyl (aminoethylamino-isobutyl) siloxane with viscosity of 1,500 cs.) was treated.

In a cleaning vessel 80 grams of water was loaded first. Then the dyed textile treated with the softener, 0.3 grams of the cleaning composition and 0.03 grams of 50% NaOH were loaded, and stirred for 60 minutes at a temperature of 90 degrees C. The cleaning solution was drained off and the textile was rinsed with water. 0.014 grams of 60% acetic acid was added to neutralize the fabric. The textile was again rinsed with water and dried.

The dried textile was observed to find complete removal of the silicone softener by dropping water, and no difference between the fresh dyed textile and the redyed textile after removal of the silicone softener.

We claim:

1. A process for cleaning textiles which comprises applying a composition comprising a low molecular weight linear siloxane of the formula:

$$CH_3((CH_3)_2SiO)_nSi(CH_3)_2CH_3$$

wherein n is an integer from 1 to 7, and a cationic surfactant to stained textiles and heating the textiles in the presence of an inorganic base compound at a temperature below which the textiles are deteriorated.

2. The process of claim 1, wherein the cationic surfactant is a quaternary ammonium salt.

3. The process of claim 1, wherein the cationic surfactant is selected from the group consisting of trialkylmethylammonium salts, dialkyldimethylammonium salts, and mixtures thereof.

4. The process of claim 1, wherein the cationic surfactant is selected from the group consisting of trilaurylmethyl ammonium chloride and didecyldimethyl ammonium chloride.

5. The process of claim 3, wherein the composition further comprises alkylbenzyldimethylammonium salts in combination with the cationic surfactant.

6. The process of claim 1, wherein the inorganic base compound is selected from the group consisting of NaOH, KOH, $Na_2CO_3$, and $NaHCO_3$.

7. The process of claim 1, wherein the siloxane is selected from the group consisting of dimers, trimers and tetramers.

8. The process of claim 1, wherein the composition further comprises a non-ionic surfactant.

9. The process of claim 1, wherein the composition further comprises an organic solvent.

10. The process of claim 1, wherein the composition is in the form of an emulsion.

11. The process of claim 1, wherein the low molecular weight linear siloxane and the cationic surfactant are present in amounts such that a ratio of low molecular weight siloxane: cationic surfactant is in the range of about 1:25 to 25:1.

12. The process of claim 1, wherein the low molecular weight linear siloxane, the cationic surfactant, and the base compound are present in amounts such that a ratio of a sum of the amounts of the low molecular weight siloxane plus the cationic surfactant: the base compound is in the range of about 16:1 to 16:20.

13. The process of claim 1, wherein the temperature is above the room temperature.

14. The process of claim 13, wherein the temperature is in the range of about 80 to 100 degrees C.

15. The process of claim 1, wherein the textiles are heated for about 30 minutes to 3 hours.

16. The process of claim 1, wherein any oily and/or greasy stains are removed from the textiles.

17. The process of claim 1, wherein silicone retained onto the textiles is removed from the textiles.

* * * * *